US010689879B2

(12) United States Patent
Messelis

(10) Patent No.: US 10,689,879 B2
(45) Date of Patent: Jun. 23, 2020

(54) FENCING MESH AND FENCE

(71) Applicant: BETAFENCE HOLDING NV, Ghent (BE)

(72) Inventor: Timothy Messelis, Lauwe (BE)

(73) Assignee: BETAFENCE HOLDING NV (BE)

( * ) Notice: Subject to any disclaimer, the term of this patent is extended or adjusted under 35 U.S.C. 154(b) by 208 days.

(21) Appl. No.: 15/314,328

(22) PCT Filed: May 26, 2015

(86) PCT No.: PCT/IB2015/053922

§ 371 (c)(1),
(2) Date: Nov. 28, 2016

(87) PCT Pub. No.: WO2015/181715

PCT Pub. Date: Dec. 3, 2015

(65) Prior Publication Data

US 2017/0096835 A1 Apr. 6, 2017

(30) Foreign Application Priority Data

May 27, 2014 (BE) ..... 2014/0404

(51) Int. Cl.
*E04H 17/04* (2006.01)
*F41H 5/02* (2006.01)
(Continued)

(52) U.S. Cl.
CPC ..... *E04H 17/04* (2013.01); *E04H 17/12* (2013.01); *E04H 17/161* (2013.01); *E04H 17/20* (2013.01);
(Continued)

(58) Field of Classification Search
CPC ..... E04H 17/02; E04H 17/04; E04H 17/10; E04H 17/16; E04H 17/161; E04H 17/163; E04H 17/24
See application file for complete search history.

(56) References Cited

U.S. PATENT DOCUMENTS 4,159,361 A * 6/1979 Schupack ..... B28B 19/0092 442/63
4,188,020 A * 2/1980 Herrig ..... E04H 17/04 256/45
(Continued)

FOREIGN PATENT DOCUMENTS

EP 1422362 A2 * 5/2004 ..... E04H 17/161
EP 1607551 A1 * 12/2005 ..... E04H 17/10
(Continued)

OTHER PUBLICATIONS

International Search Report dated Oct. 15, 2015.

*Primary Examiner* — Jonathan P Masinick
(74) *Attorney, Agent, or Firm* — Fresh IP PLC; Aubrey Y Chen

(57) ABSTRACT

A fencing mesh for protecting an interior space from projectiles, comprising a first set of wires which are arranged essentially parallel with respect to each other and a second set of wires which are arranged essentially parallel with respect to each other, have a greater tensile strength than the wires of the first set and intersect the first set of wires. In addition, the present invention relates to a fence comprising such a fencing mesh.

20 Claims, 4 Drawing Sheets

(51) Int. Cl.

| | |
|---|---|
| ***E04H 17/16*** | (2006.01) |
| ***E04H 17/12*** | (2006.01) |
| ***F41H 5/013*** | (2006.01) |
| ***E04H 17/20*** | (2006.01) |
| ***E04H 17/24*** | (2006.01) |

(52) U.S. Cl.
CPC ..... *E04H 17/24* (2013.01); *F41H 5/013* (2013.01); *F41H 5/026* (2013.01)

(56) References Cited

U.S. PATENT DOCUMENTS 4,209,153 A * 6/1980 Vanvlaenderen ..... B21F 27/005 245/8
4,940,874 A * 7/1990 Ritter ..... B23K 11/008 219/56
5,542,649 A * 8/1996 Allegaert ..... E04H 17/161 256/32
6,010,116 A * 1/2000 Knott, Sr. ..... E04H 17/161 256/24
7,866,635 B2 * 1/2011 Payne ..... E04H 17/161 256/24
8,840,089 B2 * 9/2014 Walker ..... A01K 3/005 256/10
2006/0038165 A1 * 2/2006 Larsen ..... B21F 27/005 256/32
2008/0308780 A1 * 12/2008 Sloan ..... E01F 13/12 256/31
2009/0321701 A1 * 12/2009 Payne ..... E04H 3/08 256/57
2010/0102166 A1 4/2010 Konstantinovskiy
2011/0062404 A1 * 3/2011 Shepherd ..... E04H 17/161 256/34
2013/0069027 A1 * 3/2013 Zimmermann ..... E01F 13/06 256/24
2014/0318891 A1 * 10/2014 Crothers ..... E04G 5/14 182/113
2014/0353564 A1 * 12/2014 Shepherd ..... E04H 17/04 256/24
2015/0104261 A1 * 4/2015 Aspinwall ..... E21D 11/152 405/259.1
2015/0315809 A1 * 11/2015 Catteeuw ..... E04H 17/161 256/24
2015/0337558 A1 * 11/2015 Shepherd ..... E04H 17/02 256/24

FOREIGN PATENT DOCUMENTS

| | | | |
|---|---|---|---|
| EP | 1712710 | A1 | 10/2006 |
| WO | WO92/00496 | A1 | 1/1992 |
| WO | WO99/43894 | A1 | 9/1999 |
| WO | WO03/101726 | A1 | 12/2003 |
| WO | WO2009/159428 | A1 | 12/2009 |

* cited by examiner

FENCING MESH AND FENCE

This application claims the benefit of Belgian Patent Application No. 2014/0404, filed May 27, 2014, which is hereby incorporated by reference in its entirety.

FIELD OF THE INVENTION

The present invention relates to a fencing mesh for protecting an interior space from projectiles, comprising a first set of wires which are arranged essentially parallel with respect to each other and a second set of wires which are arranged essentially parallel with respect to each other and intersect the first set of wires, wherein the wires of the first set are connected to the wires of the second set at the locations where they intersect.

In addition, the present invention relates to a fence comprising such a fencing mesh. Furthermore, the present invention also relates to a method for producing a specific embodiment of such a fencing mesh.

BACKGROUND

A number of fence systems comprising fencing mesh and configured to be able to catch projectiles are already known on the market. The fencing mesh of these fence systems is typically a woven wire mesh which is sufficiently flexible to be able to absorb the impact of projectiles striking it. Such fence systems are described, for example, in WO 99/43894 A1 and WO 2005/120744.

In practice, such fence systems are inter alia also used to construct screenings for potential targets of attackers in order to intercept projectiles, such as for example, rocket-launched grenades and to detonate these before the actual target. In this way, for example ships or chemical installations or drilling platforms, etc. are screened off from potential attacks. When used for such applications, these fencing mesh panels can only span very small surface areas and also require sufficient external support. Therefore, these systems are not very suitable for screening off large surface areas in this way.

WO 92/00496 and US 2010/0102166 describe fencing mesh panels for protecting an interior space from projectiles which comprise a first set of wires and a second set of wires, wherein the wires of the second set have a greater tensile strength than the wires of the first set. This makes it possible to protect larger surface areas from projectiles using such a fencing mesh.

By providing two types of wires, each having a different tensile strength, it is possible to construct a fencing mesh, in which the wires having a greater tensile strength provide the strength of the fencing mesh, so that less external support is required in order to construct a fence. The wires having a lower tensile strength in turn provide sufficient flexibility in the fencing mesh to be able to absorb the kinetic energy of the projectiles upon impact.

With a fencing mesh as described in WO 92/00496, the principal aim is to cause projectiles to explode before the fencing mesh. When projectiles explode, the damage to such a fencing mesh is relatively extensive.

By contrast, with a fencing mesh as described in US 2010/0102166, it is preferred to allow projectiles to penetrate the fencing mesh, in which case they are affected by the fencing mesh in order to cause a detonation at some determined distance behind the fencing mesh. This makes it possible to limit the damage to the fencing mesh, but it requires a relatively large distance behind the fencing mesh in order to explode the projectiles at a safe distance from both the fencing mesh and from a target in the interior space to be protected.

The object of the present invention is to provide a fencing mesh which also makes it possible to protect relatively large surface areas in a simple way to protect against projectiles, wherein this fencing mesh is only damaged to a minimal degree upon impact and a smaller distance is required between the fencing mesh and a potential target to be protected in the interior space.

This object of the invention is achieved by providing a fencing mesh, comprising a first set of wires which are arranged essentially parallel with respect to each other and a second set of wires which are arranged essentially parallel with respect to each other and intersect the first set of wires, wherein the wires of the first set are connected to the wires of the second set at the locations where they intersect, wherein the wires of the second set have a greater tensile strength than the wires of the first set, and wherein the wires are welded to one another in order to connect them to each other.

By welding the wires to one another in order to connect them to each other, it is ensured that, when projectiles strike, the wires having a lower tensile strength move apart sufficiently, so that a projectile can be caught between the wires and damaged. The wires having a greater tensile strength retain the structure of the fencing mesh as well as possible and are welded to the wires having a lower tensile strength in such a way that the projectile cannot pass through the fencing mesh. In this way, a projectile can become buried in the fencing mesh, thus reducing the functionality of such a projectile.

According to the invention, it is thus no longer intended to cause a projectile to explode before the fence or behind the fence, but to limit its effect. As a result of the more limited impact and welding the wires together, the fencing mesh is only damaged to a limited degree upon detonation of the projectiles.

The term 'welding' is to be interpreted broadly in the sense of any process or treatment, optionally with the addition of welding materials or bonding materials or products, and optionally accompanied by (local) heating of the parts to be connected, which results in a durable connection without external coupling means having a substantially mechanical connecting function.

The wires of a fencing mesh according to the present invention may have various forms. Preferably, however, they have an essentially round cross section.

The tensile strengths and diameters of the wires, as well as the intermediate distances between the wires are preferably chosen as a function of the expected projectiles which this fencing mesh serves to be able to catch.

The wires of the first set preferably have a tensile strength of less than 550 MPa. Still more preferably, these wires have a tensile strength of more than 300 MPa. Furthermore, these wires of the first set preferably have a diameter of at most 3 mm.

The wires of the second set preferably have a tensile strength of more than 550 MPa. Furthermore, these wires of the second set preferably have a diameter of at least 3 mm.

The intermediate distance between the wires of the first set is preferably smaller than the intermediate distance between the wires of the second set. Still more preferably, this intermediate distance between the wires of the first set is preferably at least twice as small as the intermediate distance between the wires of the second set.

The intermediate distance between the wires of the first set is preferably chosen to be between 15 mm and 35 mm and is preferably essentially 20 mm.

The intermediate distance between the wires of the second set is preferably chosen to be between 30 mm and 70 mm and is preferably essentially 40 mm.

The wires of a fencing mesh according to the present invention may furthermore be made of different kinds of materials. Preferably, however, the wires of the second set are made of steel.

The wires of the first set are preferably also made of steel.

When steel wires are used as the wires in a fencing mesh according to the present invention, then these are preferably galvanized.

In a particular embodiment of a fencing mesh according to the present invention, the first set of wires and the second set of wires intersect essentially at right angles.

The wires of the second set of a fencing mesh according to the present invention are furthermore preferably designed to extend essentially vertically in the fitted position of the fencing mesh. When the first set of wires and the second set of wires of such a fencing mesh extend essentially at right angles to one another, the wires of the first set are designed to extend essentially horizontally in the fitted position of the fencing mesh.

The object of the present invention is furthermore also achieved by providing a fence for protecting an interior space from projectiles, comprising a post and a fencing mesh according to the present invention as described above, which is attached to said post.

Such a fence is only suitable for catching specific types of projectiles and to detonate these before the actual target, if said projectiles contain explosives. Since the projectiles are caught and damaged in the fence, the explosion of these projectiles is also reduced. Depending on the situation, a second fence will be arranged at a distance from this fence in order, for example, to collect shrapnel after the detonation of a projectile on the fence according to the present invention or to be able to catch different types of projectiles.

In a fence according to the present invention, the wires of the first set are preferably arranged substantially facing the interior space to be protected and the wires of the second set are preferably arranged substantially facing away from this interior space. Such an arrangement of the wires results in a reduced effect of the detonation of projectiles.

Furthermore, with a fence according to the present invention, the fencing mesh is preferably attached to the post at an intermediate distance from said post. This increases the possibility of moving apart in a flexible manner and thus to absorb kinetic energy from projectiles hitting the fencing mesh.

BRIEF DESCRIPTION OF THE DRAWINGS

The present invention will now be described in more detail by means of the following detailed description of a few preferred embodiments of a fencing mesh and a fence according to the present invention. The aim of this description is solely to give illustrative examples and to indicate further advantages and particulars of the present invention, and can thus not be interpreted as a limitation of the area of application of the invention or of the patent rights defined in the claims.

In this detailed description, reference numerals are used to refer to the attached drawings, in which.

Figure 1:
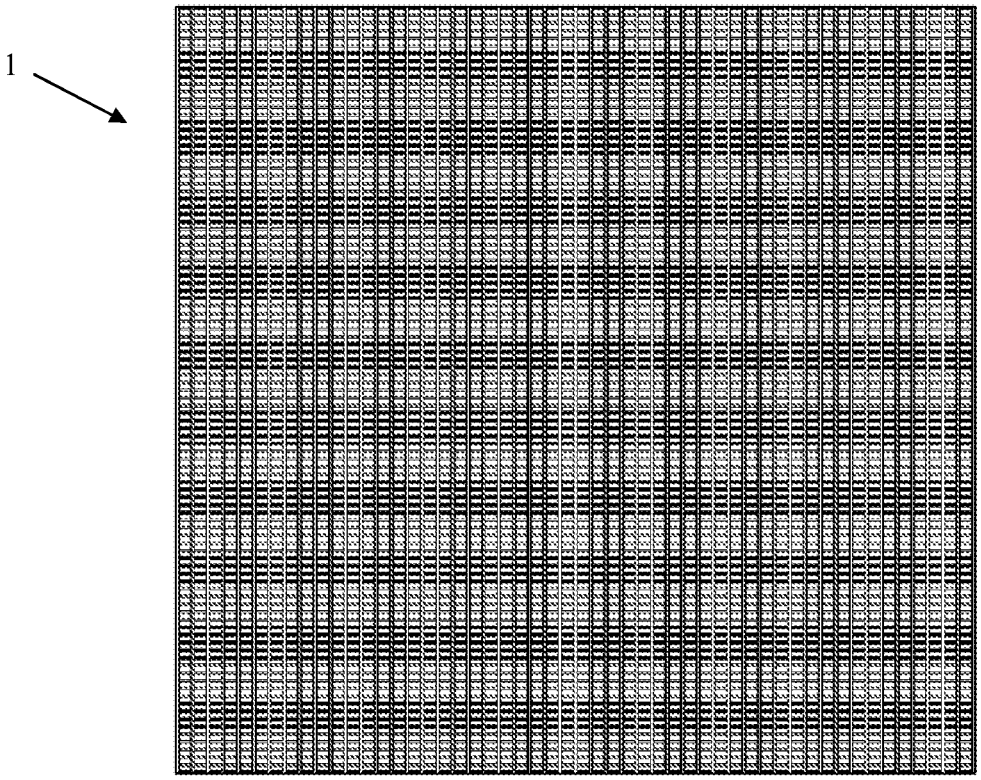
FIG. 1 shows an embodiment of a fencing mesh according to the present invention in front view.
Figure 2:
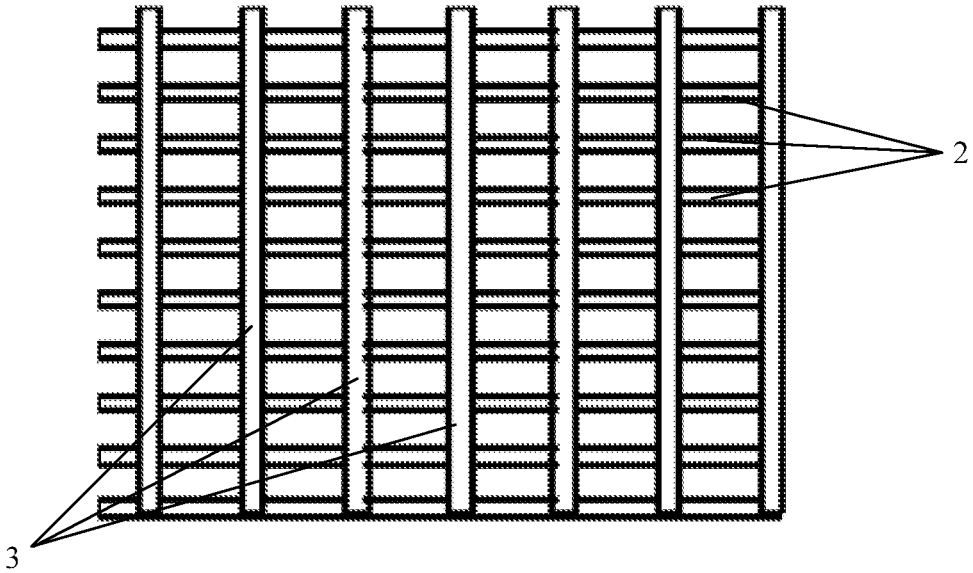
FIG. 2 shows a detail of the fencing mesh from FIG. 1.
Figure 3:
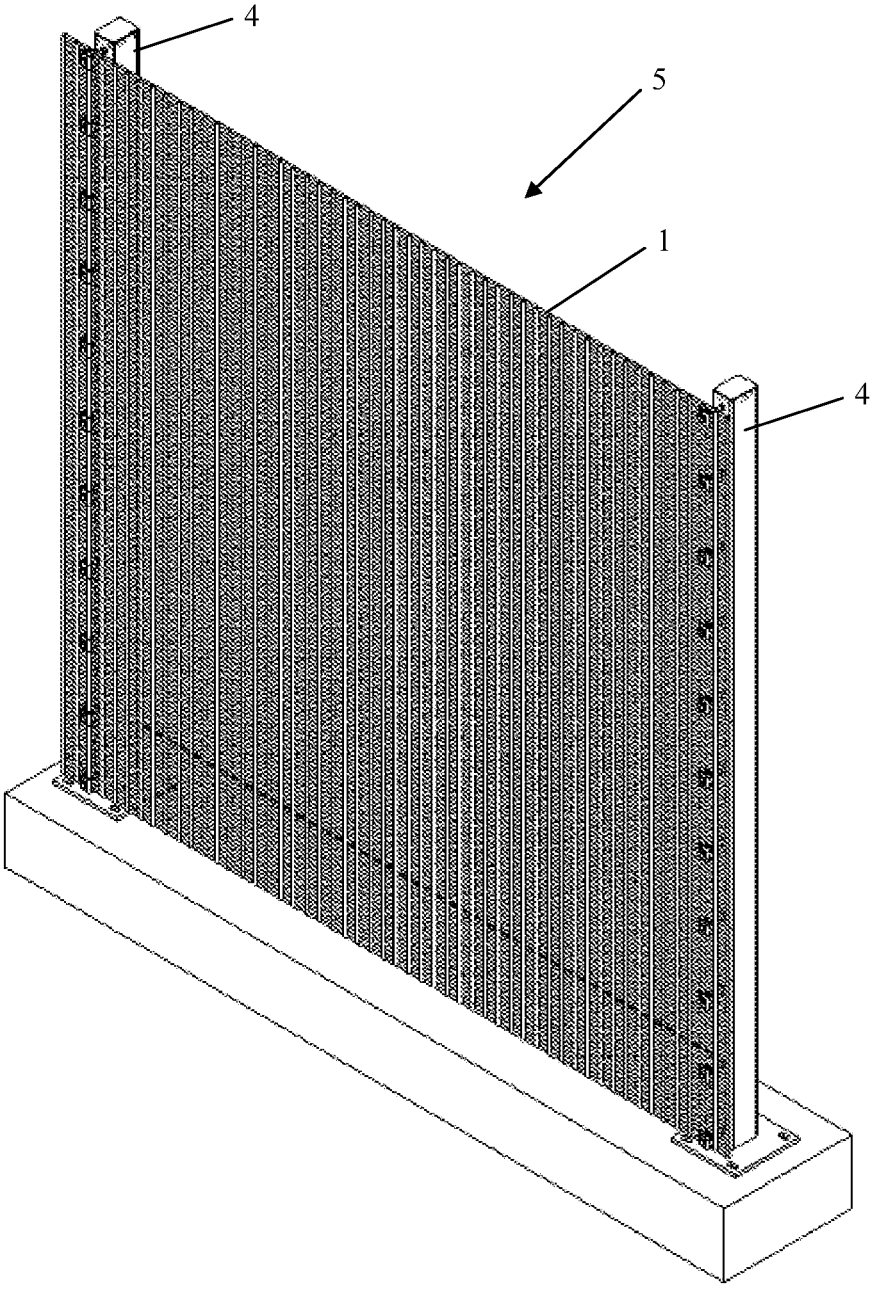
FIG. 3 shows an embodiment of a fence according to the present invention in perspective view.
Figure 4:
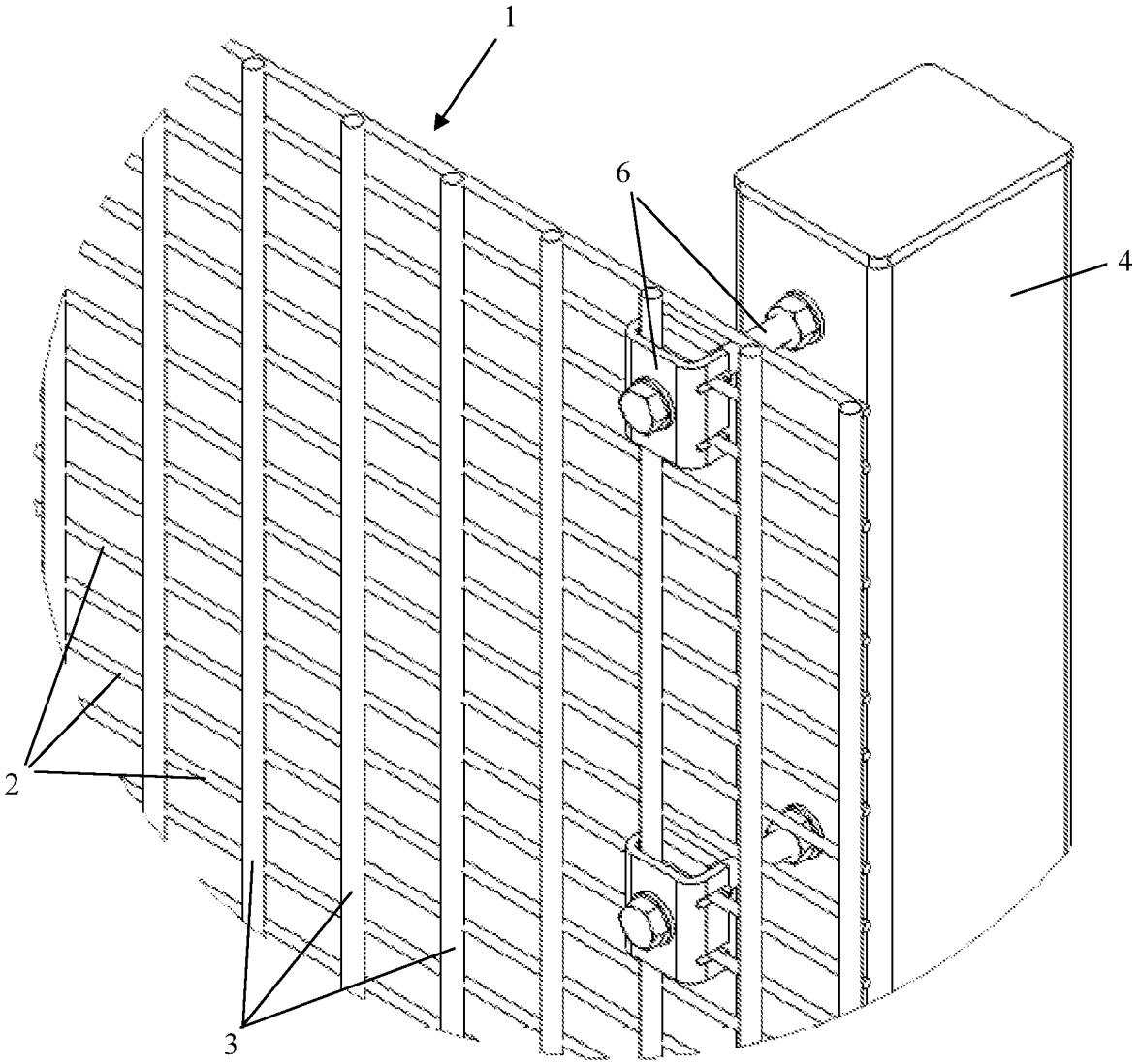
FIG. 4 shows the top right-hand corner of the fence from FIG. 3 in more detail in perspective view.
Figure 5:
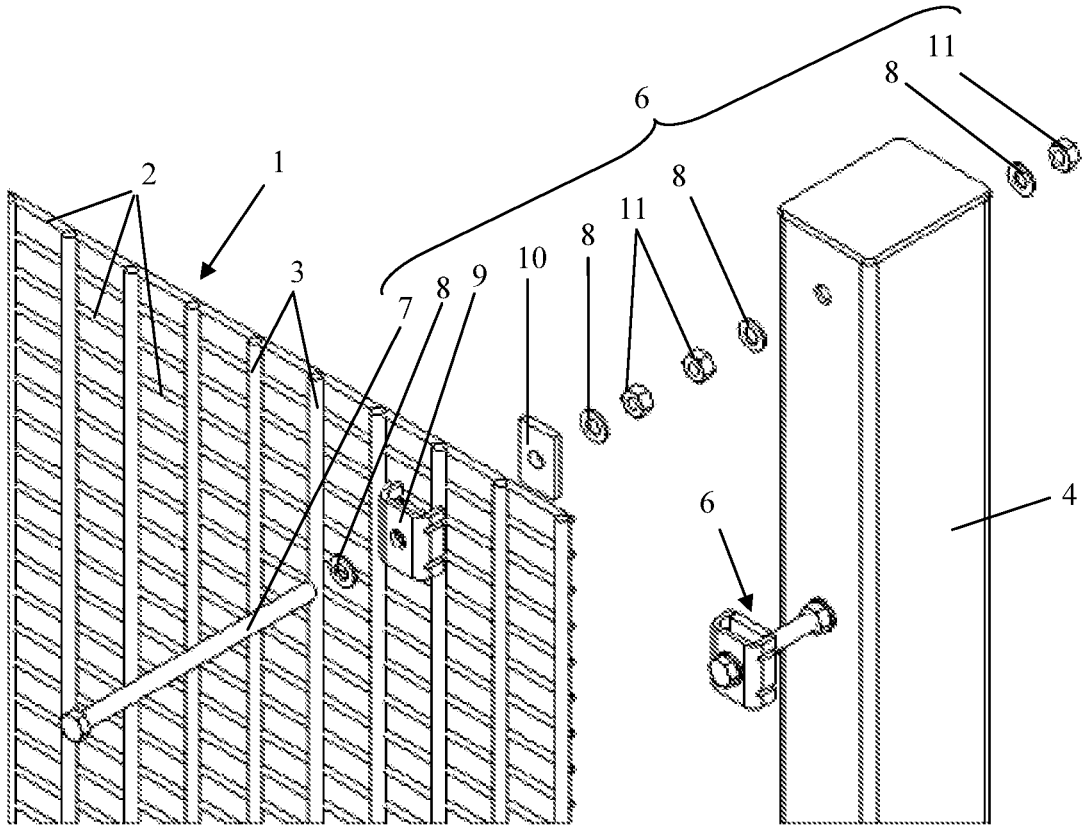
FIG. 5 shows the top right-hand corner of the fence from FIG. 3 in more detail in cut-away perspective view.

The fencing mesh (1) illustrated in FIGS. 1-5 comprises a first set of wires (2) which are arranged essentially parallel to one another and which, as can be seen in FIGS. 3-5, extend essentially horizontally in the fitted position of the fencing mesh (1). In addition to this first set of wires (2), the fencing mesh (1) also comprises a second set of wires (3) which are arranged essentially parallel to one another and extend essentially vertically in the fitted position of the fencing mesh (1).

The wires (2, 3) in each case comprise a round cross section. Alternative cross sections are conceivable, but less preferred. These wires (2, 3) are preferably made of steel.

The wires (2) of the first set have a tensile strength of between 300 MPa and 550 MPa. To this end, they have a diameter of at most 3 mm.

The wires (3) of the second set have a tensile strength of more than 550 MPa. To this end, they have a diameter of at least 3 mm.

In the first embodiment illustrated in FIGS. 1-5, the wires (2) of the first set and the wires (3) of the second set are welded to one another where they intersect. In this way, a fencing mesh (1) having essentially rectangular meshes is obtained. In the illustrated embodiments, the fencing mesh (1) in each case comprises rectangular meshes. In alternative, but less preferred embodiments, a fencing mesh according to the present invention may also be provided with different kinds of mesh shapes, such as for example diamond-shaped meshes or hexagonal meshes, etc.

The intermediate distance between the wires (2) of the first set is then chosen to be between 15 mm and 35 mm and is preferably essentially 20 mm. The intermediate distance between the wires (3) of the second set is then chosen to be between 30 and 70 mm and is preferably essentially 40 mm. These intermediate distances are preferably measured between the centres of the weld spots of the wires (2, 3). The term "essentially" is used to indicate that these values correspond to the values given within a certain tolerance. For the first set of wires (2), this tolerance is preferably ±1 mm. For the second set of wires (3), this tolerance is preferably ±2 mm. These dimensions and the above-described tensile strengths of the wires (2, 3) are chosen such that the most common rocket-launched grenades can be caught in the meshes, so that this projectile becomes lodged and detonates at the location of this fencing mesh. In this case, the fencing mesh (1) absorbs the kinetic energy of the projectile, due to the flexibility of the wires (2) of the first set. The impact on the fence (5) in this case remains limited to a minimum, partly due to the strength of the wires (3) of the second set. In this way, the fence (5) is as impenetrable as possible, both before and after the impact, partly due to the small intermediate distance between the wires (2) of the first set.

As a result of the strength of the wires (3) of the second set, such a fencing mesh (1) can be made to relatively large sizes and can be placed with a minimum of support.

FIGS. 3-5 show how a fencing mesh (1) according to the present invention can be incorporated in a fence (5). This may be effected in a variety of ways by attaching it to posts (4) using all kinds of possible attachment means (6). In the illustrated embodiment, the fencing mesh (1) is attached here to a post (4) by means of attachment means (6) at an intermediate distance. To this end, these attachment means (6) may comprise, for example a bolt (7), nuts (11), washers (8), a clamp (9) and a clamping plate (10), as is illustrated in FIG. 5.

The invention claimed is:

1. Fencing mesh for protecting an interior space from projectiles, comprising a first set of wires which are arranged essentially parallel with respect to each other and a second set of wires which are arranged essentially parallel with respect to each other and intersect the first set of wires, wherein the wires of the first set are connected to the wires of the second set at the locations where they intersect and the wires of the second set have a greater tensile strength than the wires of the first set, wherein the wires are welded to one another in order to connect them to each other.

2. Fencing mesh according to claim 1, characterized in that the wires of the first set have a tensile strength of less than 550 MPa.

3. Fencing mesh according to claim 2, characterized in that the wires of the first set have a tensile strength of more than 300 MPa.

4. Fencing mesh according to claim 1, characterized in that the wires of the first set have a diameter of at most 3 mm.

5. Fencing mesh according to claim 1, characterized in that the wires of the second set have a tensile strength of more than 550 MPa.

6. Fencing mesh according to claim 1, characterized in that the wires of the second set have a diameter of at least 3 mm.

7. Fencing mesh according to claim 1, characterized in that an intermediate distance between the wires of the first set is smaller than an intermediate distance between the wires of the second set.

8. Fencing mesh according to claim 1, characterized in that an intermediate distance between the wires of the first set is essentially 20 mm.

9. Fencing mesh according to claim 1, characterized in that an intermediate distance between the wires of the second set is essentially 40 mm.

10. Fencing mesh according to claim 1, characterized in that the wires of the second set are made of steel.

11. Fencing mesh according to claim 1, characterized in that the wires of the first set are made of steel.

12. Fencing mesh according to claim 1, characterized in that the wires of the first set intersect the wires of the second set essentially at right angles.

13. Fencing mesh according to claim 1, characterized in that the wires of the second set are designed to extend essentially vertically in the fitted position of the fencing mesh.

14. Fence for protecting an interior space from projectiles, comprising a post and a fencing mesh which is attached to said post, characterized in that the fencing mesh is a fencing mesh according to claim 1.

15. Fence according to claim 14, characterized in that the wires of the first set are arranged substantially facing the interior space and the wires of the second set are arranged substantially facing away from the interior space.

16. Fence according to claim 14, characterized in that the fencing mesh is attached to the post at an intermediate distance from said post.

17. Fence according to claim 1, characterized in that the wires of the first set have a tensile strength of less than 550 MPa and more than 300 MPa, that the wires of the first set have a diameter of at most 3 mm, the wires of the second set have a tensile strength of more than 550 MPa, the wires of the second set have a diameter of at least 3 mm, an intermediate distance between the wires of the first set is essentially 20 mm, an intermediate distance between the wires of the second set is essentially 40 mm, the wires of the second set are made of steel, the wires of the first set are made of steel, the wires of the first set intersect the wires of the second set essentially at right angles, and the wires of the second set are designed to extend essentially vertically in the fitted position of the fencing mesh.

18. Fence according to claim 1, characterized in that the wires of the first set have a tensile strength of less than 550 MPa and more than 300 MPa and a diameter of at most 3 mm, the wires of the second set have a tensile strength of more than 550 MPa and a diameter of at least 3 mm, an intermediate distance between the wires of the first set is smaller than an intermediate distance between the wires of the second set, the wires of the first set intersect the wires of the second set essentially at right angles, and the wires of the second set are designed to extend essentially vertically in the fitted position of the fencing mesh.

19. Fence according to claim 1, characterized in that an intermediate distance between the wires of the first set is smaller than an intermediate distance between the wires of the second set, the intermediate distance between the wires of the first set is between 15 mm and 35 mm and the intermediate distance between the wires of the second set is between 30 mm and 70 mm, the wires of the first set intersect the wires of the second set essentially at right angles, and the wires of the second set are designed to extend essentially vertically in the fitted position of the fencing mesh.

20. Fence according to claim 1, characterized in that the wires of the first set have a tensile strength of less than 550 MPa and more than 300 MPa and a diameter of at most 3 mm, the wires of the second set have a tensile strength of more than 550 MPa and a diameter of at least 3 mm.

* * * * *